US009976719B2

(12) United States Patent
Nishimura

(10) Patent No.: US 9,976,719 B2
(45) Date of Patent: May 22, 2018

(54) DIFFUSION LIGHT DISTRIBUTION OPTICAL SYSTEM AND VEHICLE LIGHTING APPARATUS

(71) Applicant: Stanley Electric Co., Ltd., Tokyo (JP)

(72) Inventor: Shota Nishimura, Hadano (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 57 days.

(21) Appl. No.: 15/291,961

(22) Filed: Oct. 12, 2016

(65) Prior Publication Data

US 2017/0114974 A1 Apr. 27, 2017

(30) Foreign Application Priority Data

Oct. 27, 2015 (JP) ..... 2015-211167

(51) Int. Cl.
*F21S 8/10* (2006.01)

(52) U.S. Cl.
CPC ..... *F21S 48/1225* (2013.01); *F21S 48/1159* (2013.01); *F21S 48/1266* (2013.01); *F21S 48/1291* (2013.01); *F21S 48/1329* (2013.01)

(58) Field of Classification Search
CPC ..... F21S 48/1266; F21S 48/1159; F21S 48/1291; F21S 48/1329; F21S 41/00; B60Q 1/04
See application file for complete search history.

(56) References Cited

U.S. PATENT DOCUMENTS

| | | | | |
|---|---|---|---|---|
| 9,534,755 | B2 * | 1/2017 | Blandin | F21S 48/1109 |
| 9,664,352 | B2 * | 5/2017 | Scheibner | F21S 48/125 |
| 2006/0215415 | A1 * | 9/2006 | Suzuki | F21S 48/1159 362/539 |
| 2008/0151567 | A1 | 6/2008 | Albou | |
| 2014/0078768 | A1 * | 3/2014 | de Lamberterie | F21S 48/1388 362/517 |
| 2014/0092619 | A1 * | 4/2014 | Bushre | F21S 48/1154 362/520 |
| 2014/0233253 | A1 | 8/2014 | Owada | |

FOREIGN PATENT DOCUMENTS

| | | | |
|---|---|---|---|
| DE | 20 2007 001 829 | U1 | 6/2007 |
| JP | 2004-241349 | A | 8/2004 |
| JP | 4068387 | B2 | 3/2008 |

OTHER PUBLICATIONS

Extended European search report for the related European Patent Application No. 16194217.2 dated Mar. 30, 2017.

* cited by examiner

*Primary Examiner* — Karabi Guharay
(74) *Attorney, Agent, or Firm* — Kenealy Vaidya LLP

(57) ABSTRACT

In a diffusion light distribution optical system configured such that a plurality of lens bodies are arranged to be aligned in a vehicle width direction, second emission surfaces of the plurality of lens bodies form a continuous emission surface having a semicircular column shape and extending in a line in the vehicle width direction in a state where the second emission surfaces are adjacent to each other, and one or more lens bodies of the plurality of lens bodies are arranged in a state where an optical axis of a first lens unit is slanted with respect to a vehicle travel direction.

12 Claims, 7 Drawing Sheets

DIFFUSION LIGHT DISTRIBUTION OPTICAL SYSTEM AND VEHICLE LIGHTING APPARATUS

CROSS-REFERENCE TO RELATED APPLICATION

Priority is claimed on Japanese Patent Application No. 2015-211167, filed on Oct. 27, 2015, the contents of which are incorporated herein by reference.

BACKGROUND

Field of the Invention

The present invention relates to a diffusion light distribution optical system and a vehicle lighting apparatus. Specifically, the present invention relates to a diffusion light distribution optical system used in combination with a light source and a vehicle lighting apparatus including the diffusion light distribution optical system.

Background

In the related art, vehicle lighting apparatuses including a light source in combination with a lens body have been proposed (for example, refer to Japanese Unexamined Patent Application, First Publication No. 2004-241349 and Japanese Patent No. 4068387). In the vehicle lighting apparatus, light from a light source is incident on an incidence surface of the lens body to enter the inside of the lens body, and part of the light is reflected by a reflection surface of the lens body. Then, the light is emitted to the outside of the lens body from an emission surface of the lens body. Thereby, the light emitted frontward of the lens body forms a low beam light distribution pattern which is a reverse projection of a light source image formed in the vicinity of a focal point of the emission surface of the lens body and which has an upper end edge including a cutoff line defined by a front end part of the reflection surface.

SUMMARY

In the vehicle lighting apparatus described above, a slant angle (also referred to as a camber angle depending on the slant direction) may be added to a final emission surface of the lens body in accordance with a slant shape added to a corner part of a front end of the vehicle. For example, in the lens body to which a slant angle is added at the final emission surface, the final emission surface is slanted at a predetermined angle (slant angle) such that the final emission surface at an outer position in the vehicle width direction is positioned more rearward in the vehicle travel direction than the final emission surface at an inner position in the vehicle width direction.

However, in the lens body to which a slant angle is added at the final emission surface, there is a case in which a Fresnel reflection loss or the like may occur due to the final emission surface being slanted, and a light use efficiency when the light emitted from the light source is diffusively distributed may be degraded.

An object of an aspect of the present invention is to provide a diffusion light distribution optical system that is capable of diffusively distributing light emitted from a light source efficiently and to provide a vehicle lighting apparatus including the diffusion light distribution optical system.

In order to achieve the above object, an aspect of the present invention is a diffusion light distribution optical system that includes a lens body that diffusively distributes light emitted from a light source toward a vehicle travel direction and that is configured such that a plurality of the lens bodies are arranged to be aligned in a vehicle width direction, wherein: the lens body has a first lens unit that includes a first incidence surface, a reflection surface, and a first emission surface and a second lens unit that includes a second incidence surface and a second emission surface, the lens body being configured such that light from the light source is incident on the first incidence surface to enter an inside of the first lens unit, part of the light is reflected by the reflection surface, then the light is emitted to an outside of the first lens unit from the first emission surface, the light is further incident on the second incidence surface to enter an inside of the second lens unit, the light is emitted to an outside of the second lens unit from the second emission surface, and thereby, the light emitted frontward of the lens body forms a predetermined light distribution pattern which has an upper end edge including a cutoff line defined by a front end part of the reflection surface; the first emission surface is configured as a lens surface having a semicircular column shape having a cylindrical axis that extends in a vertical direction such that the light emitted from the first emission surface is focused in a horizontal direction; the second emission surface is configured as a lens surface having a semicircular column shape having a cylindrical axis that extends in a horizontal direction such that the light emitted from the second emission surface is focused in a vertical direction; the second emission surfaces of the plurality of lens bodies form a continuous emission surface having a semicircular column shape and extending in a line in the vehicle width direction in a state where the second emission surfaces are adjacent to each other; and one or more lens bodies of the plurality of lens bodies are arranged in a state where an optical axis of the first lens unit is slanted with respect to the vehicle travel direction.

According to the diffusion light distribution optical system of the aspect, the optical axis of the first lens unit is slanted with respect to the vehicle travel direction, and thereby, it is possible to diffusively distribute light outward in the vehicle width direction.

According to the diffusion light distribution optical system of the aspect, among the first and second lens units forming the lens body, the first emission surface of the first lens unit has a function that light is focused in a horizontal direction, and the second emission surface of the second lens unit has a function that light is focused in a vertical direction. Thereby, it is possible to form a predetermined light distribution pattern in which light is focused in the horizontal direction and the vertical direction while dividing the light focus function into the first emission surface and the second emission surface.

According to the diffusion light distribution optical system of the aspect, the second emission surfaces of the plurality of lens bodies form a continuous emission surface having a semicircular column shape and extending in a line in the vehicle width direction in a state where the second emission surfaces are adjacent to each other. Therefore, it is possible to provide a diffusion light distribution optical system of a unified appearance extending in a line in the vehicle width direction.

In the above-described diffusion light distribution optical system, the first lens unit may have an imaginary rotation axis and be slanted to a rotation direction around the rotation axis, and the rotation axis may be a line that extends in a vertical direction and passes through at least a contact point between the optical axis of the first lens unit and the first emission surface.

According to the configuration, the optical path length between the first emission surface and the second emission surface is not greatly changed. Therefore, the optical axis of the first lens unit can be slanted with respect to the vehicle travel direction while avoiding an impact on the light distribution.

In the above-described diffusion light distribution optical system, the continuous emission surface may be slanted at a predetermined angle such that the continuous emission surface at an outer position in the vehicle width direction is positioned more rearward in the vehicle travel direction than the continuous emission surface at an inner position in the vehicle width direction, and the one or more lens bodies of the plurality of lens bodies may be arranged in a state where the optical axis of the first lens unit is slanted in the same direction as an optical axis of the second lens unit with respect to the vehicle travel direction in accordance with the angle at which the continuous emission surface is slanted.

According to the configuration, the second emission surface (continuous emission surface) which is a final emission surface of each lens body is slanted at a predetermined angle (slant angle), and the optical axis of the first lens unit is slanted to the same direction as the optical axis of the second lens unit with respect to the vehicle travel direction in accordance with the slant angle at which the continuous emission surface is slanted. Thereby, it is possible to prevent a Fresnel reflection loss or the like from occurring, and it is possible to enhance the light use efficiency when the light emitted from the light source is diffusively distributed.

In the above-described diffusion light distribution optical system, the direction of the optical axis of the first lens unit and the direction of the optical axis of the second lens unit may be coincident with each other.

According to the configuration, the optical axis of the first lens unit can be slanted to the same direction and at the same angle (slant angle) as the optical axis of the second lens unit with respect to the vehicle travel direction. In this case, the Fresnel reflection loss or the like can be minimized, and it is possible to maximally enhance the light use efficiency when the light emitted from the light source is diffusively distributed.

In the above-described diffusion light distribution optical system, the one or more lens bodies arranged in a state where the optical axis of the first lens unit is slanted with respect to the vehicle travel direction may be arranged such that one of the lens bodies is arranged at an outermost position in the vehicle width direction and the rest of the lens bodies are arranged toward inner positions in sequence from the outermost position.

According to the configuration, it is possible to diffusively distribute light outward in the vehicle width direction efficiently.

In the above-described diffusion light distribution optical system, a lens body other than the one or more lens bodies arranged in a state where the optical axis of the first lens unit is slanted with respect to the vehicle travel direction may be arranged such that the optical axis of the first lens unit is directed to the vehicle travel direction.

According to the configuration, it is possible to form a light distribution pattern in which light is widely diffused in the vehicle width direction.

Another aspect of the present invention is a vehicle lighting apparatus that includes: the above-described diffusion light distribution optical system; and a plurality of light sources each emitting light toward the first incidence surface of one of the plurality of lens bodies forming the diffusion light distribution optical system.

According to the configuration, it is possible to provide a vehicle lighting apparatus including a diffusion light distribution optical system that can prevent a Fresnel reflection loss or the like from occurring and enhance the light use efficiency when the light emitted from the light source is diffusively distributed.

As described above, according to the aspect of the present invention, it is possible to provide a diffusion light distribution optical system that is capable of diffusively distributing light emitted from a light source efficiently and to provide a vehicle lighting apparatus including the diffusion light distribution optical system.

Figure 6:
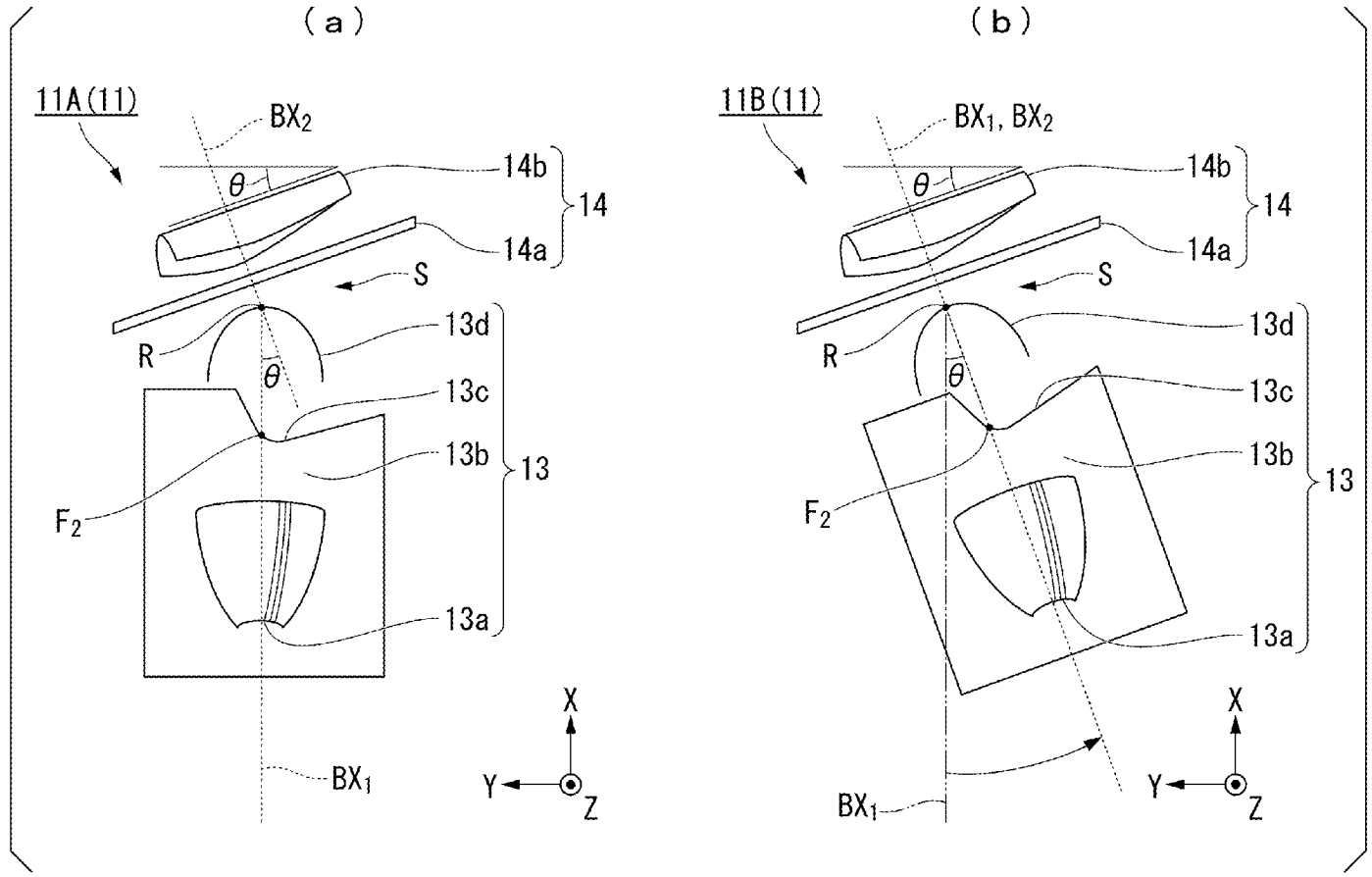

Part (a) of FIG. 6 is a top view showing an arrangement of a first lens body. Part (b) of FIG. 6 is a top view showing an arrangement of a second lens body.

Figure 7:
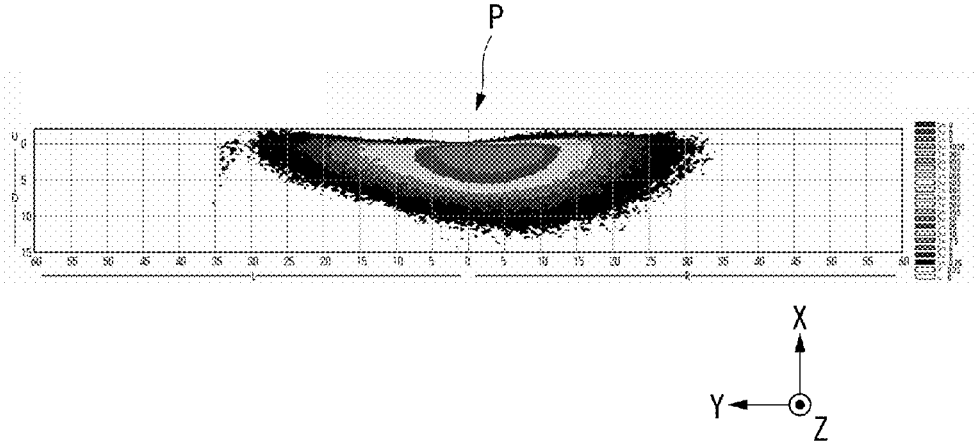

FIG. 7 is a luminous intensity distribution map showing a light distribution pattern formed on an imaginary vertical screen plane by the first lens body shown in part (a) of FIG. 6.

Figure 8:
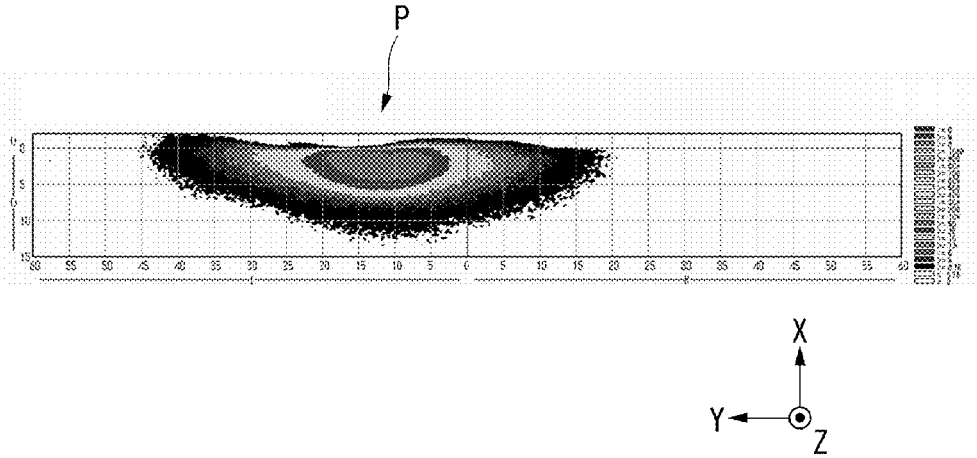

FIG. 8 is a luminous intensity distribution map showing a light distribution pattern formed on an imaginary vertical screen plane by the second lens body shown in part (b) of FIG. 6.

Figure 1:
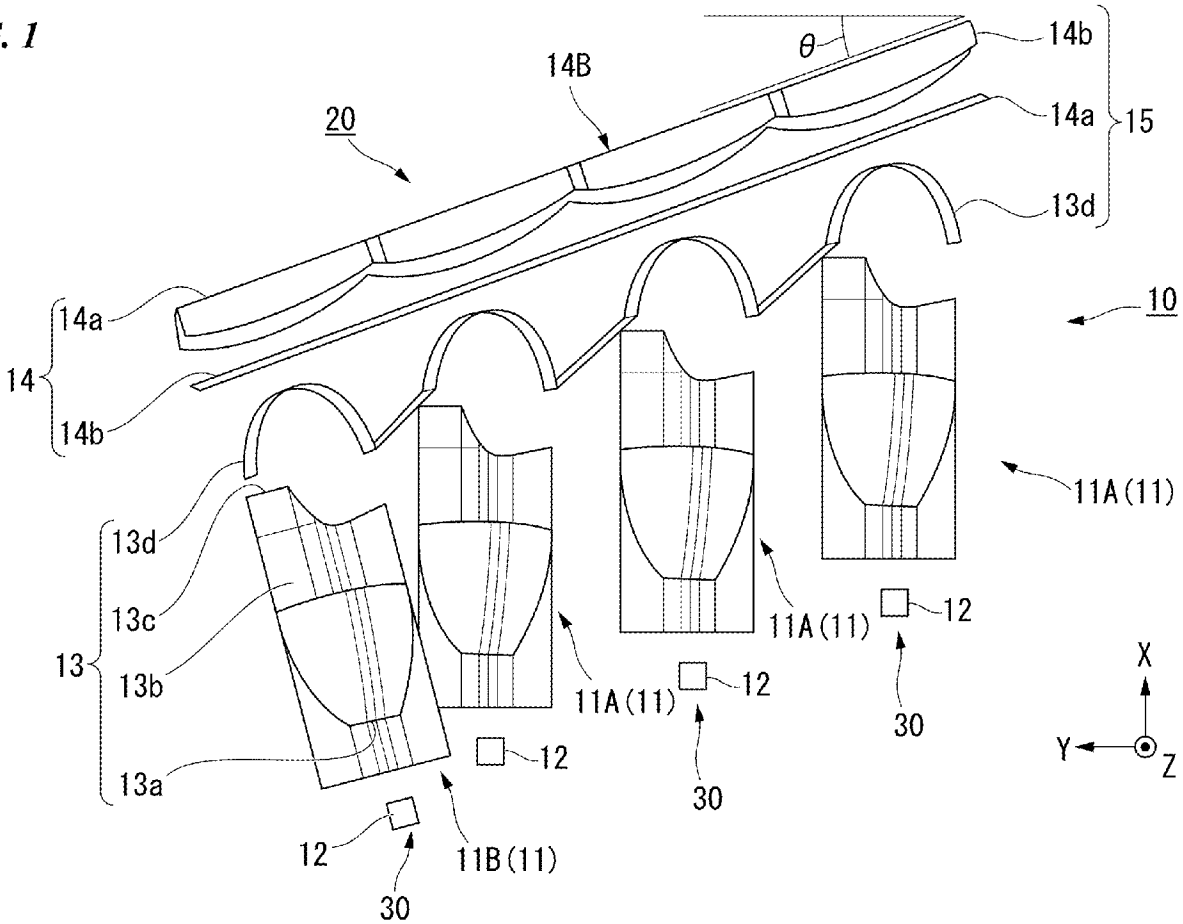
FIG. 1 is a top view showing a schematic configuration of a vehicle lighting apparatus including a diffusion light distribution optical system according to an embodiment of the present invention.
Figure 9:
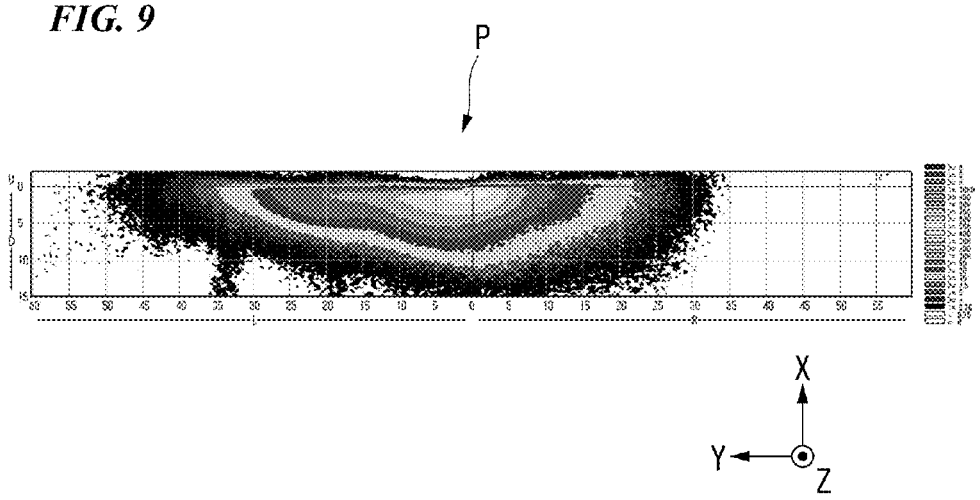

FIG. 9 is a luminous intensity distribution map showing a combination light distribution pattern formed on an imaginary vertical screen plane by the diffusion light distribution optical system shown in FIG. 1.

Figure 10:
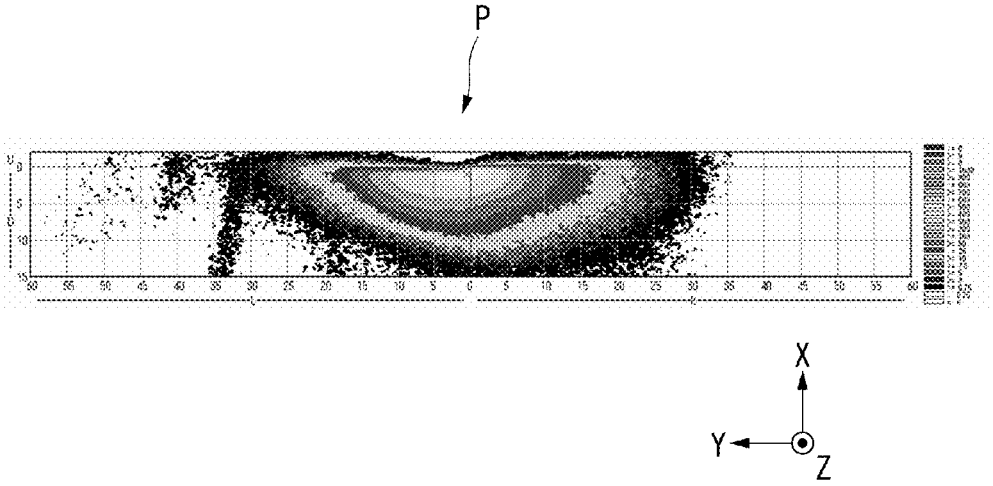

FIG. 10 is a luminous intensity distribution map showing a combination light distribution pattern formed on an imaginary vertical screen plane by the diffusion light distribution optical system when no second lens body is provided.

DESCRIPTION OF THE EMBODIMENTS

Hereinafter, an embodiment of the present invention is described in detail with reference to the drawings.

In the drawings used in the following description, there may be a case in which, for ease of understanding the components, the components are shown using different dimension reduction scales depending on the component, and the dimension ratio of each component or the like is not always the same as an actual one.

Figure 2:
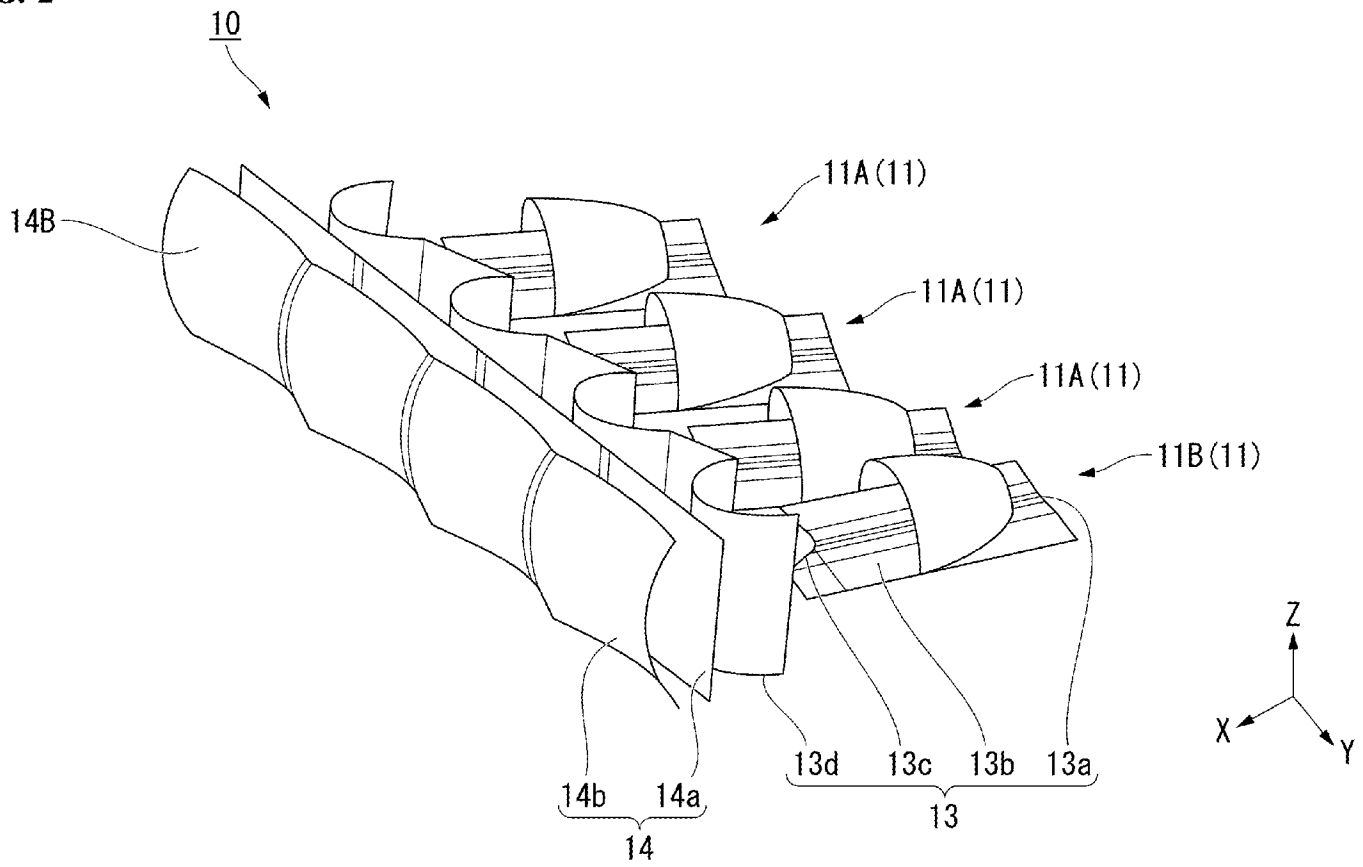
FIG. 2 is a perspective view showing a main surface configuration of the diffusion light distribution optical system shown in FIG. 1.

As an embodiment of the present invention, for example, a vehicle lighting apparatus 20 that includes a diffusion light distribution optical system 10 shown in FIG. 1 and FIG. 2 is described. FIG. 1 is a top view showing a schematic configuration of the vehicle lighting apparatus 20 including the diffusion light distribution optical system 10. FIG. 2 is a perspective view showing a main surface configuration of the diffusion light distribution optical system 10. In the drawings described below, an XYZ orthogonal coordinate system is set in which an X-axis direction is represented as the front-to-rear direction of the vehicle lighting apparatus 20 (diffusion light distribution optical system 10), a Y-axis direction is represented as the right-to-left direction of the vehicle lighting apparatus 20 (diffusion light distribution optical system 10), and a Z-axis direction is represented as the vertical direction of the vehicle lighting apparatus 20 (diffusion light distribution optical system 10).

The vehicle lighting apparatus 20 of the present embodiment is a vehicle headlamp arranged at both corner parts (the embodiment is described using an example of a left corner part) of a vehicle front end as shown in FIG. 1 and FIG. 2. Specifically, the vehicle lighting apparatus 20 includes a plurality of (in the embodiment, four) lamp body cells 30. The plurality of lamp body cells 30 is formed of the diffusion light distribution optical system 10 and a plurality of (in the embodiment, four) light sources 12. The diffusion light distribution optical system 10 is formed of a plurality of (in the embodiment, four) lens bodies 11. One of the plurality of light sources 12 illuminates each of the plurality of lens bodies 11 with light.

The vehicle lighting apparatus 20 has a configuration in which the lamp body cells 30 are arranged in a line in a vehicle width direction (Y-axis direction). The lens bodies 11 each forming one of the lamp body cells 30 have basically the same configuration. The light sources 12 each forming one of the lamp body cells 30 have basically the same configuration.

Figure 3:
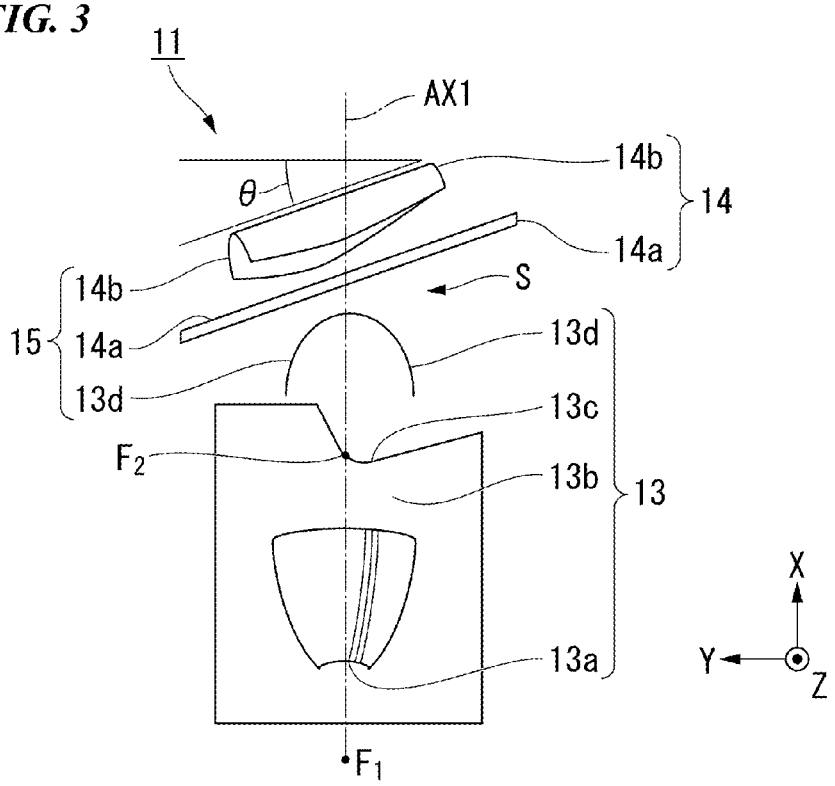
FIG. 3 is a plan view showing a schematic configuration of a lens body that forms the diffusion light distribution optical system shown in FIG. 1.
Figure 4:
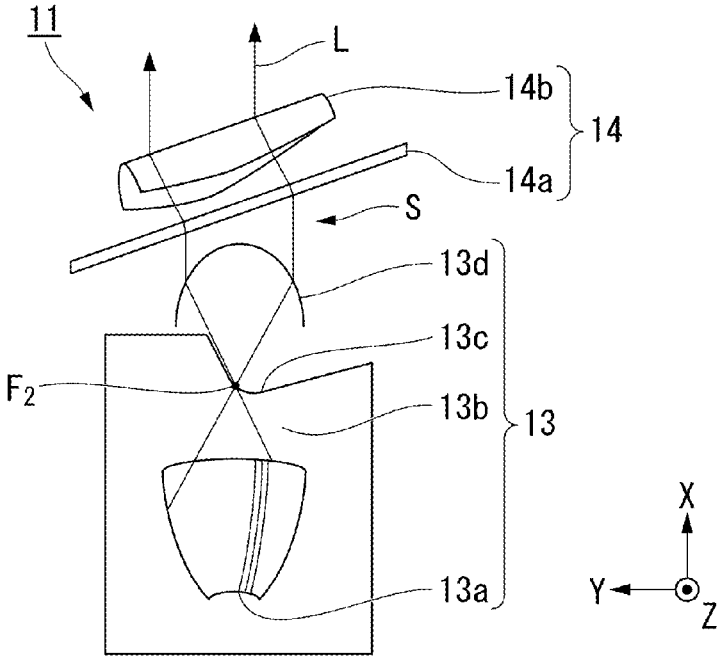
FIG. 4 is a top view showing an optical path of light that is incident on the lens body shown in FIG. 3.
Figure 5:
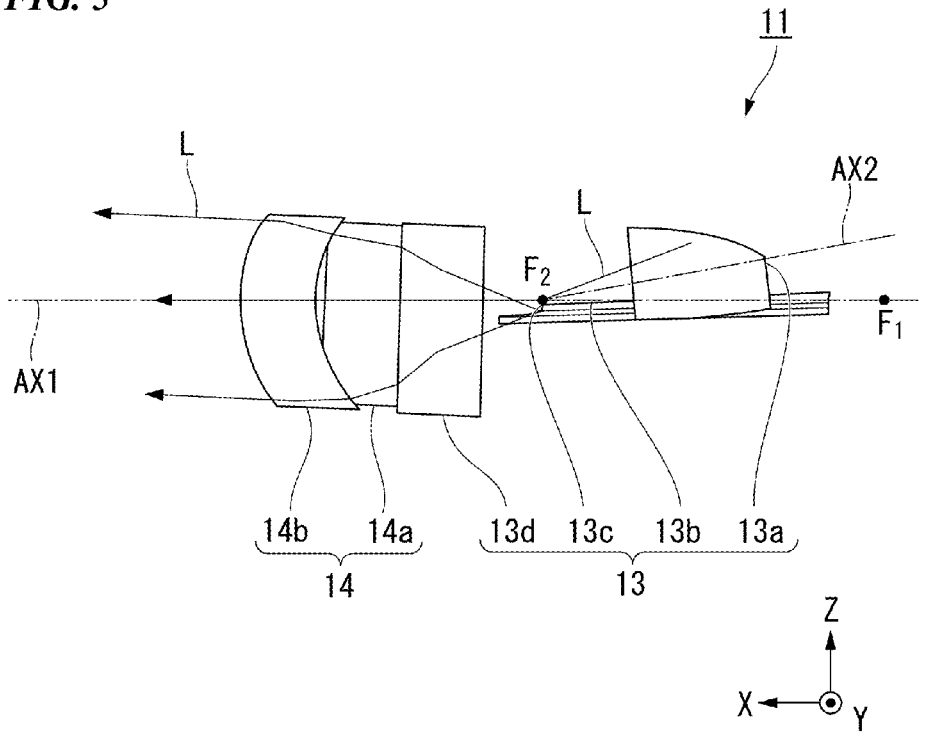
FIG. 5 is a side view showing an optical path of light that is incident on the lens body shown in FIG. 3.

Specific configuration of the lamp body cell 30 (lens body 11 and light source 12) is described with reference to FIG. 3 to FIG. 5. FIG. 3 is a plan view showing a schematic configuration of the lens body 11. FIG. 4 is a top view showing an optical path of light L that is incident on the lens body 11. FIG. 5 is a side view showing an optical path of light L that is incident on the lens body 11.

As shown in FIG. 3 to FIG. 5, the lens body 11 has a first lens unit 13 that includes a first incidence surface 13*a*, a reflection surface 13*b*, and a first emission surface 13*d* and a second lens unit 14 that includes a second incidence surface 14*a* and a second emission surface 14*b*. The first emission surface 13*d* of the first lens unit 13 and the second emission surface 14*b* of second lens unit 14 are opposed to each other via a space S.

The first lens unit 13 is a multifaceted lens body having a shape elongated in the front-to-rear direction (X-axis direction) along a first reference axis AX1 extending in a horizontal direction (X-axis direction). Specifically, the first lens unit 13 has a configuration in which the first incidence surface 13*a*, the reflection surface 13*b*, and the first emission surface 13*d* are arranged in this order along the first reference axis AX1.

For example, a material having a higher refractive index than air such as glass or a transparent plastic such as polycarbonate or acrylic can be used for the first lens unit 13. When a transparent plastic is used for the first lens unit 13, it is possible to form the first lens unit 13 by injection molding using a metal mold.

The first incidence surface 13*a* is positioned at a rear end part (rear surface) of the first lens unit 13. The first incidence surface 13*a* forms a lens surface (for example, a free curved surface that is convex toward the light source 12) at which the light L from the light source 12 (optically designed reference point $F_1$, to be exact) arranged in the vicinity of the first incidence surface 13*a* is refracted and enters the inside of the first lens unit 13.

The surface shape of the first incidence surface 13*a* is adjusted such that, regarding at least the vertical direction (Z-axis direction), the light L from the light source 12 arranged in the vicinity of the first incidence surface 13*a* passes through the center (reference point $F_1$) of the light source 12 and a point (combination focal point $F_2$ of a combination lens 15 described below) in the vicinity of a front end part 13*c* of the reflection surface 13*b* and focuses close to a second reference axis AX2 slanted frontward and diagonally downward with respect to the first reference axis AX1.

The surface shape of the first incidence surface 13*a* is configured such that, regarding the horizontal direction (Y-axis direction), the light L from the light source 12 that has entered the inside of the first lens unit 13 focuses close to the first reference axis AX1 toward the front end part 13*c* of the reflection surface 13*b*. The surface shape of the first incidence surface 13*a* may be configured such that, regarding the horizontal direction (Y-axis direction), the light L from the light source 12 that has entered the inside of the first lens unit 13 becomes parallel to the first reference axis AX1.

The reflection surface 13*b* has a flat surface shape that extends in the horizontal direction (X-axis direction) frontward (+X-axis direction) from the lower end edge of the first incidence surface 13*a*. The reflection surface 13*b* internally reflects (total reflection) the light L that is incident on the reflection surface 13*b*, of the light L from the light source 12 that has entered the inside of the first lens unit 13, toward the frontward first emission surface 13*d* in the first lens unit 13. Thereby, the reflection surface 13*b* can be formed in the first lens unit 13 without using a metallic reflection coating according to metal vapor deposition, and therefore, it is possible to avoid an increase in costs, a decrease in reflectivity, and the like.

The reflection surface 13*b* may be slanted frontward and diagonally downward with respect to the first reference axis AX1. In this case, it is possible to enhance the use efficiency of the light reflected at the reflection surface 13*b* while preventing part of the light L reflected at the reflection surface 13*b* from being light (stray light) that travels in a direction in which the light is not incident on the first emission surface 13*d*.

The front end part 13*c* of the reflection surface 13*b* defines a cutoff line of the light L from the light source 12 that has entered the inside of the first lens unit 13. The front end part 13*c* of the reflection surface 13*b* is formed so as to extend in the right-to-left direction (Y-axis direction) of the first lens unit 13.

The front end part 13*c* of the reflection surface 13*b* has a step shape that corresponds to the cutoff line. The front end part 13*c* of the reflection surface 13*b* is not necessarily limited to the above-described step shape. An appropriate change can be added to the step shape in a range in which the cutoff line can be defined. The front end part 13*c* of the reflection surface 13*b* can be also formed of a groove that corresponds to the cutoff line in place of the above-described step shape.

The first emission surface 13*d* is positioned at a front end part (front surface) of the first lens unit 13. The first emission surface 13*d* is configured as a lens surface having a semicircular column shape having a cylindrical axis that extends in the vertical direction (Z-axis direction) such that the light L emitted from the first emission surface 13*d* is focused in the horizontal direction (Y-axis direction). The focal line of the first emission surface 13*d* extends in the vertical direction (Z-axis direction) in the vicinity of the front end part 13*c* of the reflection surface 13*b*.

The second lens unit 14 is a lens body having a shape elongated in the right-to-left direction (Y-axis direction). The second lens unit 14 has a configuration in which the second incidence surface 14*a* and the second emission surface 14*b* are arranged in this order along the first reference axis AX1.

Similarly to the first lens unit 13, for example, a material having a higher refractive index than air such as glass or a transparent plastic such as polycarbonate or acrylic can be used for the second lens unit 14. When a transparent plastic is used for the second lens unit 14, it is possible to form the second lens unit 14 by injection molding using a metal mold.

The second incidence surface 14*a* is positioned at a rear end part (rear surface) of the second lens unit 14. The second incidence surface 14*a* forms a flat surface as a surface on which the light L emitted from the first emission surface 13*d* is incident. The shape of the second incidence surface 14*a* is not limited to such a flat surface and can be a curved surface (lens surface).

The second emission surface 14*b* is positioned as a final emission surface at a front end part (front surface) of the second lens unit 14. The second emission surface 14*b* is configured as a lens surface having a semicircular column shape having a cylindrical axis that extends in the horizontal direction (Y-axis direction) such that the light L emitted from the second emission surface 14*b* is focused in the vertical direction (Z-axis direction). The focal line of the second emission surface 14*b* extends in the horizontal direction (Y-axis direction) in the vicinity of the front end part 13*c* of the reflection surface 13*b*.

The combination focal point $F_2$ of the combination lens 15 formed of the first emission surface 13*d*, the second incidence surface 14*a*, and the second emission surface 14*b* is set in the vicinity of the front end part 13*c* of the reflection surface 13*b* (for example, in the vicinity of the center in the right-to-left direction of the front end part 13*c* of the reflection surface 13*b*).

Other surfaces, which are not shown in the drawings and for which descriptions are omitted, of the surfaces forming the first lens unit 13 and the second lens unit 14 can be freely designed in a range where the light L that passes the inside of the first lens unit 13 and the second lens unit 14 is not negatively impacted (for example, is not shielded).

For example, as shown in FIG. 1 and FIG. 2, a semiconductor light emitting device such as a while light emitting diode (LED) and a white laser diode (LD) can be used for the light source 12. In the present embodiment, a single white LED is used. The type of the light source 12 is not specifically limited. A light source other than the above-described semiconductor light emitting device may be used.

The light source 12 is arranged in the vicinity (in the vicinity of the reference point $F_1$) of the first incidence surface 13*a* of the first lens unit 13 in a state where the light emission surface of the light source 12 is directed frontward and diagonally downward, that is, in a state where the optical axis of the light source 12 is coincident with the second reference axis AX2. The light source 12 may be arranged in the vicinity (in the vicinity of the reference point $F_1$) of the first incidence surface 13*a* of the first lens unit 13 in a state (for example, a state where the optical axis of the light source 12 is arranged to be parallel to the first reference axis AX1) where the optical axis of the light source 12 is not coincident with the second reference axis AX2.

In the above-described lamp body cell 30 formed of the lens body 11 and the light source 12, of the light L from the light source 12 that is incident on the first incidence surface 13*a* to enter the inside of the first lens unit 13, light (reflected light) that travels toward the first emission surface 13*d* after reflected at the reflection surface 13*b* and light (straight traveling light) that travels toward the first emission surface 13*d* are emitted from the first emission surface 13*d* to the outside (space S) of the first lens unit 13. Then, the light L passes through the space S and is incident on the second incidence surface 14*a* to enter the inside of the second lens unit 14. Then, the light L is emitted to the outside of the second lens unit 14 from the second emission surface 14*b*.

Thereby, the light L emitted frontward of the lens body 11 forms a low beam (LB) light distribution pattern (not shown) which is a reverse projection of a light source image formed in the vicinity of the combination focal point $F_2$ of the combination lens 15 and which has an upper end edge including a cutoff line defined by the front end part 13*c* of the reflection surface 13*b*.

As shown in FIG. 1 and FIG. 2, the vehicle lighting apparatus 20 of the present embodiment diffusively distributes the light L emitted from the light source 12 of each lamp body cell 30 toward the vehicle travel direction by the lens body 11. Thereby, a light distribution pattern that is a combination of the LB light distribution patterns each being formed by one of the lamp body cells 30 is formed.

In the diffusion light distribution optical system 10 of the present embodiment, the second lens units 14 of the lens bodies 11 are arranged in a line in the vehicle width direction (Y-axis direction) in a state where the second lens units 14 are adjacent to each other. Thereby, the second emission surfaces 14*b* of the plurality of lens bodies 11 form a continuous emission surface 14B having a semicircular column shape and extending in a line in the vehicle width direction (Y-axis direction) in a state where the second emission surfaces 14*b* are adjacent to each other.

The diffusion light distribution optical system 10 is not limited to a configuration in which the second lens units 14 are monolithically formed. An integrated configuration can also be made by separately forming the second lens units 14 and then holding the separately formed second lens units 14 using a holding member such as a lens holder.

The vehicle lighting apparatus 20 of the present embodiment includes the diffusion light distribution optical system 10 of a unified appearance extending in a line in such a horizontal direction, and thereby, it is possible to improve the design properties of the vehicle lighting apparatus 20.

In the diffusion light distribution optical system 10 of the present embodiment, a slant angle θ is added to a continuous emission surface 14B which becomes the final emission surface of the lens body 11 in accordance with the slant shape added to the corner part of the vehicle front end. That is, the continuous emission surface 14B is slanted at a predetermined angle (slant angle) θ such that the continuous emission surface 14B at an outer position (+Y-axis direction) in the vehicle width direction (Y-axis direction) is positioned more rearward (−X-axis direction) in the vehicle travel direction (+X-axis direction) than the continuous emission surface 14B at an inner position (−Y-axis direction) in the vehicle width direction (Y-axis direction).

In the diffusion light distribution optical system 10 of the present embodiment, of the four lens bodies 11, three lens bodies 11 (hereinafter, referred to as a first lens body 11A) sequentially aligned from the inner position (−Y-axis direction) in the vehicle width direction (Y-axis direction) are arranged in a state where an optical axis $BX_1$ of the first lens unit 13 is directed toward the vehicle travel direction (+X-axis direction) as shown in FIG. 1 and part (a) of FIG. 6. Part (a) of FIG. 6 is a top view showing an arrangement of the first lens body 11A. On the other hand, an optical axis $BX_2$ of the second lens unit 14 is slanted frontward and diagonally outward with respect to the vehicle travel direction (+X-axis direction) in accordance with the slant angle θ at which the continuous emission surface 14B is slanted.

On the other hand, one lens body 11 (hereinafter, referred to as a second lens body 11B) arranged at the outermost position (+Y-axis direction) in the vehicle width direction (Y-axis direction) is arranged in a state where the optical axis $BX_1$ of the first lens unit 13 is slanted with respect to the vehicle travel direction (+X-axis direction) as shown in FIG. 1 and part (b) of FIG. 6. Part (b) of FIG. 6 is a top view showing an arrangement of the second lens body 11B. The optical axis $BX_1$ of the first lens unit 13 and the optical axis $BX_2$ of the second lens unit 14 are slanted frontward and diagonally outward with respect to the vehicle travel direction (+X-axis direction) in accordance with the slant angle θ at which the continuous emission surface 14B is slanted.

In the diffusion light distribution optical system 10 shown in FIG. 1, the first lens unit 13 that forms the second lens body 11B and the first lens unit 13 that forms the first lens body 11A next to the second lens body 11B are arranged so as to overlap with each other in a top view. The arrangement is based on that the first lens body 11A and the second lens body 11B are arranged at a different height.

A light source image according to a simulation when light emitted from the first lens body 11A is projected on an imaginary vertical screen that faces the first lens body 11A is shown in FIG. 7. A light source image according to a simulation when light emitted from the first lens body 11A is projected on an imaginary vertical screen that faces the second lens body 11B is shown in FIG. 8.

FIG. 7 is a luminous intensity distribution map showing a LB light distribution pattern P formed on an imaginary vertical screen plane by the first lens body 11A. FIG. 8 is a luminous intensity distribution map showing a LB light distribution pattern P formed on an imaginary vertical screen plane by the second lens body 11B. The imaginary vertical screen is arranged about 25 m ahead from the second emission surface 14*b* of the first lens body 11A and the second emission surface 14*b* of the second lens body 11B.

As shown in FIG. 7, the light source image by the first lens body 11A forms, on the imaginary vertical screen plane of the first lens body 11A, the LB light distribution pattern P having an upper end edge including a cutoff line defined by the front end part 13*c* of the reflection surface 13*b*. As shown in FIG. 8, the light source image by the second lens body 11B forms, on the imaginary vertical screen plane of the second lens body 11B, the LB light distribution pattern P having an upper end edge including a cutoff line defined by the front end part 13*c* of the reflection surface 13*b*.

The light source image (LB light distribution pattern P) by the second lens body 11B shown in FIG. 8 is shifted relative to the light source image (LB light distribution pattern P) by the first lens body 11A shown in FIG. 7 to the outer position (+Y-axis direction) in the vehicle width direction (Y-axis direction)

The Light Source Image by the First Lens Body 11A

In the second lens body 11B shown in part (b) of FIG. 6, the optical axis $BX_1$ of the first lens unit 13 is slanted to the same direction as the optical axis $BX_2$ of the second lens unit 14 with respect to the vehicle travel direction (+X-axis direction) in accordance with the slant angle θ at which the continuous emission surface 14B is slanted. Thereby, it is possible to prevent a Fresnel reflection loss or the like from occurring, and it is possible to enhance the light use efficiency when the light L emitted from the light source 12 is diffusively distributed.

In the second lens body 11B shown in part (b) of FIG. 6, the first lens unit 13 can be preferably slanted to a rotation direction around an imaginary rotation axis R positioned at a front end part of the first incidence surface 13*a*. The rotation axis R is a line that extends in the vertical direction (Z-axis direction) and passes through at least a contact point between the optical axis $BX_1$ of the first lens unit 13 and the first emission surface 13*a*.

In this case, the optical path length between the first emission surface 13*a* and the second emission surface 14*a* is not greatly changed. Therefore, the optical axis $BX_1$ of the first lens unit 13 can be slanted to the same direction as the optical axis $BX_2$ of the second lens unit 14 with respect to the vehicle travel direction (+X-axis direction) while avoiding an impact on the light distribution.

In the second lens body 11B shown in part (b) of FIG. 6, the direction of the optical axis $BX_1$ of the first lens unit 13 and the direction of the optical axis $BX_2$ of the second lens unit 14 are coincident with each other. Thereby, the optical axis $BX_1$ of the first lens unit 13 can be slanted to the same direction and at the same angle (slant angle θ) as the optical axis $BX_2$ of the second lens unit 14 with respect to the vehicle travel direction (+X-axis direction). In this case, the Fresnel reflection loss or the like can be minimized, and it is possible to maximally enhance the light use efficiency when the light L emitted from the light source 12 is diffusively distributed.

Accordingly, in the diffusion light distribution optical system 10 of the present embodiment, even when the slant angle θ is added to the second emission surface 14*b* of the second lens body 11B in accordance with the slant shape added to the corner part of the vehicle front end described above, it is possible to prevent a Fresnel reflection loss or the like from occurring, and it is possible to enhance the light use efficiency when the light L emitted from the light source 12 is diffusively distributed.

Further, in the present embodiment, it is possible to provide the vehicle lighting apparatus 20 including the diffusion light distribution optical system 10 that is capable of diffusively distributing light L emitted from such a light source 12 efficiently.

A light source image according to a simulation when light emitted from the diffusion light distribution optical system 10 is projected on an imaginary vertical screen that faces the diffusion light distribution optical system 10 shown in FIG. 1 is shown in FIG. 9. FIG. 9 is a luminous intensity distribution map showing a light distribution pattern P formed on an imaginary vertical screen plane by the diffusion light distribution optical system 10 shown in FIG. 1.

As a comparative example, a light source image when light emitted from a diffusion light distribution optical system is projected on the imaginary vertical screen in a case where the second lens body 11B is not provided, that is, in a case where all the four lens bodies 11 forming the diffusion light distribution optical system 10 are the first lens bodies 11A is shown in FIG. 10. FIG. 10 is a luminous intensity distribution map showing a light distribution pattern P formed on an imaginary vertical screen plane by the diffusion light distribution optical system in a case where the second lens body 11B is not provided.

As shown in FIG. 9 and FIG. 10, the diffusion light distribution optical system 10 of the present embodiment can form a light distribution pattern P in which light is widely diffused in the vehicle width direction (Y-axis direction) compared to the diffusion light distribution optical system in a case where the second lens body 11B is not provided.

The present invention is not limited to the above-described embodiment, and a variety of changes can be made without departing from the scope of the invention.

For example, in the above-described embodiment, the vehicle lighting apparatus 20 is formed of the four lamp body cells 30; however, the number of the lamp body cells 30 (lens bodies 11 forming the diffusion light distribution optical system 10) forming the vehicle lighting apparatus 20 is not specifically limited and can be suitably changed.

Further, the above embodiment is described using an example in which the diffusion light distribution optical system 10 is formed of the three first lens bodies 11A and the single second lens body 11B; however, the configuration is not limited thereto. A configuration in which a plurality of the second lens bodies 11B are provided may be used. In this case, the second lens bodies 11B can be preferably arranged at the position of the outermost (+Y-axis direction) the lens body 11 in the vehicle width direction (Y-axis direction) in sequence toward the inner position. Thereby, it is possible to diffusively distribute light outward (+Y-axis direction) in the vehicle width direction (Y-axis direction) efficiently.

The invention claimed is:

1. A diffusion light distribution optical system that comprises a lens body that diffusively distributes light emitted from a light source toward a vehicle travel direction and that is configured such that a plurality of the lens bodies are arranged to be aligned in a vehicle width direction, wherein:

the lens body has a first lens unit that includes a first incidence surface, a reflection surface, and a first emission surface and a second lens unit that includes a second incidence surface and a second emission surface, the lens body being configured such that light from the light source is incident on the first incidence surface to enter an inside of the first lens unit, part of the light is reflected by the reflection surface, then the light is emitted to an outside of the first lens unit from the first emission surface, the light is further incident on the second incidence surface to enter an inside of the second lens unit, the light is emitted to an outside of the second lens unit from the second emission surface, and thereby, the light emitted frontward of the lens body forms a predetermined light distribution pattern which has an upper end edge including a cutoff line defined by a front end part of the reflection surface;

the first emission surface is configured as a lens surface having a semicircular column shape having a cylindrical axis that extends in a vertical direction such that the light emitted from the first emission surface is focused in a horizontal direction;

the second emission surface is configured as a lens surface having a semicircular column shape having a cylindrical axis that extends in a horizontal direction such that the light emitted from the second emission surface is focused in a vertical direction;

the second emission surfaces of the plurality of lens bodies form a continuous emission surface having a semicircular column shape and extending in a line in the vehicle width direction in a state where the second emission surfaces are adjacent to each other; and one or more lens bodies of the plurality of lens bodies are arranged in a state where an optical axis of the first lens unit is slanted with respect to the vehicle travel direction.

2. The diffusion light distribution optical system according to claim 1, wherein the first lens unit has an imaginary rotation axis and is slanted to a rotation direction around the rotation axis, and the rotation axis is a line that extends in a vertical direction and passes through at least a contact point between the optical axis of the first lens unit and the first emission surface.

3. A vehicle lighting apparatus comprising:

a diffusion light distribution optical system according to claim 2; and a plurality of light sources each emitting light toward the first incidence surface of one of the plurality of lens bodies forming the diffusion light distribution optical system.

4. The diffusion light distribution optical system according to claim 1, wherein the continuous emission surface is slanted at a predetermined angle such that the continuous emission surface at an outer position in the vehicle width direction is positioned more rearward in the vehicle travel direction than the continuous emission surface at an inner position in the vehicle width direction, and the one or more lens bodies of the plurality of lens bodies are arranged in a state where the optical axis of the first lens unit is slanted in the same direction as an optical axis of the second lens unit with respect to the vehicle travel direction in accordance with the angle at which the continuous emission surface is slanted.

5. The diffusion light distribution optical system according to claim 4, wherein, the direction of the optical axis of the first lens unit and the direction of the optical axis of the second lens unit are coincident with each other.

6. A vehicle lighting apparatus comprising:

a diffusion light distribution optical system according to claim 5; and a plurality of light sources each emitting light toward the first incidence surface of one of the plurality of lens bodies forming the diffusion light distribution optical system.

7. A vehicle lighting apparatus comprising:

a diffusion light distribution optical system according to claim 4; and a plurality of light sources each emitting light toward the first incidence surface of one of the plurality of lens bodies forming the diffusion light distribution optical system.

8. The diffusion light distribution optical system according to claim 1, wherein the one or more lens bodies arranged in a state where the optical axis of the first lens unit is slanted with respect to the vehicle travel direction are arranged such that one of the lens bodies is arranged at an outermost position in the vehicle width direction and the rest of the lens bodies are arranged toward inner positions in sequence from the outermost position.

9. A vehicle lighting apparatus comprising:

a diffusion light distribution optical system according to claim 8; and a plurality of light sources each emitting light toward the first incidence surface of one of the plurality of lens bodies forming the diffusion light distribution optical system.

10. The diffusion light distribution optical system according to claim 1, wherein a lens body other than the one or more lens bodies arranged in a state where the optical axis of the first lens unit is slanted with respect to the vehicle travel direction is arranged such that the optical axis of the first lens unit is directed to the vehicle travel direction.

11. A vehicle lighting apparatus comprising:

a diffusion light distribution optical system according to claim 10; and a plurality of light sources each emitting light toward the first incidence surface of one of the plurality of lens bodies forming the diffusion light distribution optical system.

12. A vehicle lighting apparatus comprising:

a diffusion light distribution optical system according to claim 1; and a plurality of light sources each emitting light toward the first incidence surface of one of the plurality of lens bodies forming the diffusion light distribution optical system.

* * * * *